US011419406B1

(12) United States Patent
Ricard et al.

(10) Patent No.: US 11,419,406 B1
(45) Date of Patent: Aug. 23, 2022

(54) CYLINDRICAL-OBJECT HOLDER WITH BELT CLIP

(71) Applicants: Paul J Ricard, Amherst, MA (US); David M Kroll, Westfield, MA (US)

(72) Inventors: Paul J Ricard, Amherst, MA (US); David M Kroll, Westfield, MA (US)

( * ) Notice: Subject to any disclaimer, the term of this patent is extended or adjusted under 35 U.S.C. 154(b) by 263 days.

(21) Appl. No.: 16/847,547

(22) Filed: Apr. 13, 2020

Related U.S. Application Data

(60) Provisional application No. 62/837,990, filed on Apr. 24, 2019.

(51) Int. Cl.
*A45F 5/02* (2006.01)
*A47G 23/02* (2006.01)

(52) U.S. Cl.
CPC ..... *A45F 5/021* (2013.01); *A47G 23/0216* (2013.01); *A45F 2200/0566* (2013.01); *A45F 2200/0583* (2013.01)

(58) Field of Classification Search
CPC ..... A45F 5/021; A45F 2200/0566; A45F 2200/0583; A45F 2200/05; A47G 23/0216; A47G 23/02; A47G 23/0208; F16M 11/041
See application file for complete search history.

(56) References Cited

U.S. PATENT DOCUMENTS 3,369,723 A 2/1968 Saari et al.
4,363,432 A * 12/1982 Warthen ..... A45F 5/02 24/3.9
D272,775 S 2/1984 Weissenburger
4,708,273 A 11/1987 Grant
5,056,696 A 10/1991 Lahr
D373,935 S 9/1996 Cole
5,622,346 A 4/1997 Story, Jr.
5,944,238 A 8/1999 Stark
6,045,017 A 4/2000 Connell
6,457,616 B2 10/2002 Gagne
D473,760 S * 4/2003 Perez ..... B62B 9/147 D7/620
D497,779 S 11/2004 Giampavolo
D509,354 S 9/2005 Tannenhauser
D559,043 S 1/2008 Peota
D570,162 S 6/2008 Blais
7,798,380 B2 9/2010 Chekroune
8,245,892 B2 8/2012 Kriner
D669,317 S 10/2012 Giampavolo et al.
8,690,166 B2 4/2014 Peota et al.
D823,596 S * 7/2018 Grisamore ..... D3/215
10,575,625 B2 * 3/2020 Senn ..... A45F 5/021
10,668,863 B2 * 6/2020 Ferreri ..... B62B 9/147
(Continued)

*Primary Examiner* — Anita M King

(57) ABSTRACT

A uniform beverage-container, or cylindrical-object, holder, having flexible arms and a clip. The body is a substantially truncated cylinder with a partially cut front area forming arms, into which a bottle may be placed. An anchoring member in the rear part of the bottle holder serves as a clip for attaching the bottle, or cylindrical object, holder to clothing or baggage. The bottom of the holder has a laterally positioned base. The base and arms flex, allowing a container or cylindrical object, to be removed in a motion that is directed downward and outward away from the clip. This allows a container to be removed without releasing the clip from what it is attached to.

3 Claims, 5 Drawing Sheets

(56) References Cited

U.S. PATENT DOCUMENTS

| | | | | |
|---|---|---|---|---|
| D893,857 | S * | 8/2020 | Ricard | B62B 9/147 D3/201 |
| 2004/0108346 | A1 | 6/2004 | Pablo | |
| 2004/0238577 | A1 * | 12/2004 | Shivas | B60N 3/103 224/666 |
| 2008/0251552 | A1 | 10/2008 | Bell | |
| 2011/0089204 | A1 | 4/2011 | Escalante | |
| 2012/0018465 | A1 | 1/2012 | Andrews | |
| 2012/0037634 | A1 * | 2/2012 | Kiceniuk, Jr. | B44D 3/126 220/570 |
| 2014/0224761 | A1 | 8/2014 | Willows et al. | |
| 2018/0126914 | A1 * | 5/2018 | Ferreri | B62B 9/147 |

* cited by examiner

100

CYLINDRICAL-OBJECT HOLDER WITH BELT CLIP

TECHNICAL FIELD

The present invention relates generally to the field of personal container, cylindrical object, and beverage-bottle holders, and more particularly to container holders that can be attached to other objects.

BACKGROUND

In recent generations health-conscious people have increased their water intake, choosing to carry beverage bottles with them before, during and after physical activity. Because it is inconvenient to carry large packs or purses during physical activity, people seek alternative carriers for their beverage bottles. This invention also may be used with other cylindrical objects such as spray equipped cleaners, spray paint or oil cans, smaller battery or pneumatic driven grinders or tools, or other similar devices.

Bottle-holders are usually made of semi-rigid resilient plastic material such as polyethylene, polycarbonate, carbon-reinforced nylon (injection moldable) or other strong flexible plastics. Some container holders are made from metal and carbon fiber. One skilled in the art understands that a beverage bottle may refer to water bottles or bottles of any other beverage.

During travel people carry various bags that may not accommodate a beverage bottle. In this case as well, a separate bottle holder would be of convenience. This, in combination with the perceived need to multitask, has generated a market for beverage-bottle holders that attach to a person's clothing, leaving their hands free to attend to other tasks. In one example construction and warehouse workers working away from a desk may enjoy having a drink with them.

Of particular utility are bottle-holders of semi-rigid plastic and of a flexible, expandable design that can hold variously sized bottles, containers, cans, devices and similar objects that, when not clipped to one's person, can be placed upright on a flat surface without tipping. This would be very useful for rounded bottom containers or devices that will not stand upright.

SUMMARY

A flexible beverage-bottle, can, or device holder with a clip for fastening to a belt, pocket, strap or other thin structure, is constructed of a single form. The body is a substantially truncated cylinder with a partially cut front area into which a bottle or other cylindrical or similarly shaped object may be placed. At the bottom of the holder, a laterally positioned base portion supports a beverage bottle and prevents it from sliding downward. A clip has a planar form, curved to meet a person's hip, and is connected along a vertical structure to a vertical truncated cylinder. The cylinder is truncated at the top and bottom ends and has a gap, opposite the vertical structure. The form has two arms that wrap around a cylindrical beverage container.

In one embodiment, a truncated cylinder is contiguous with a curved surface that arcs away from the rear part of the truncated cylinder and then folds 180 degrees to form a clip. The entire apparatus is a single form of injection-molded plastic.

DESCRIPTION

Figure 1:
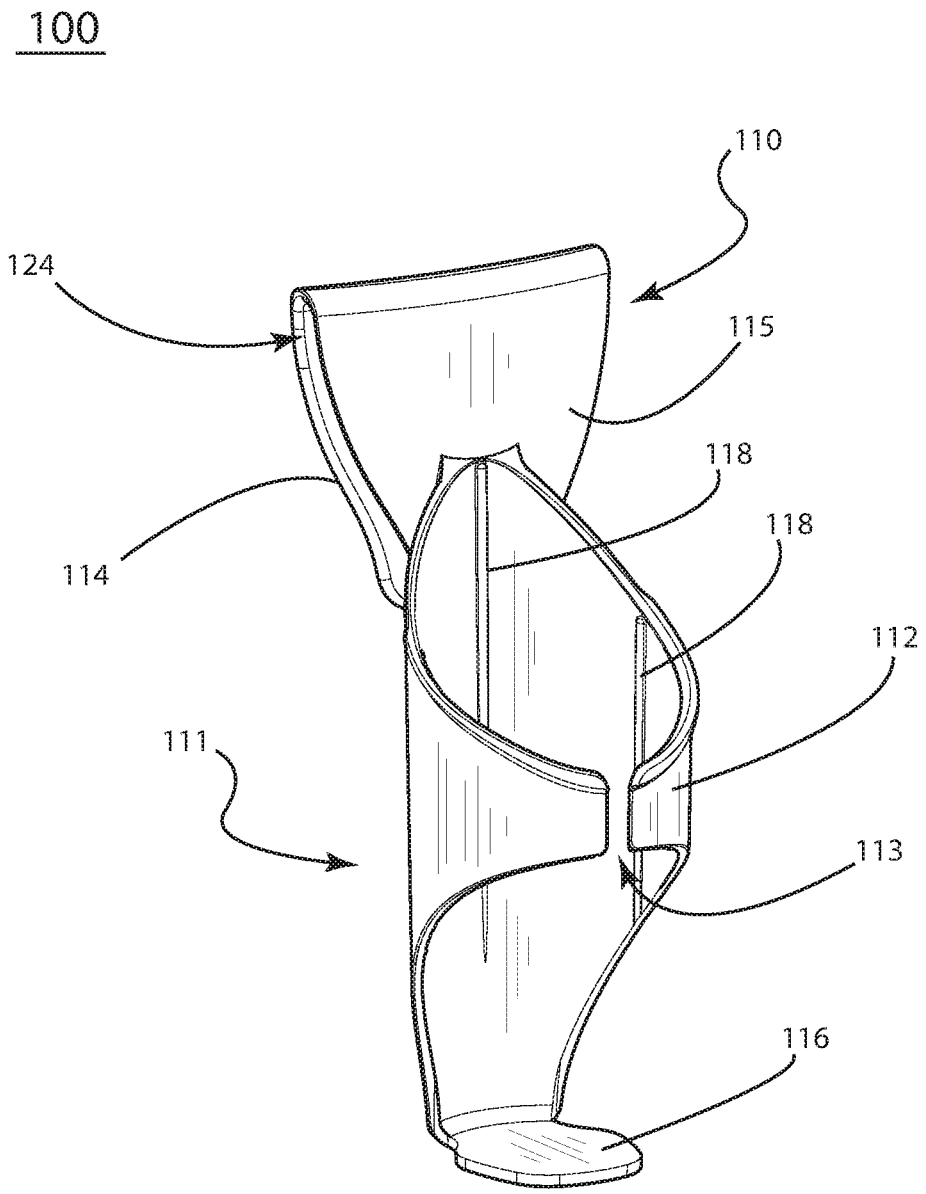
FIG. 1 is a front perspective view of the present embodiment.

FIG. 1 shows an example embodiment of a vertically oriented, truncated cylinder 111 that has a partially cut front area 112 formed to hold a water bottle. A base portion 116 that projects laterally from the truncated-cylinder body 111, is designed to support a water bottle. An integral clip 110 is disposed behind the cylindrical body 111 and is configured to secure to an article of clothing such as a waistband, pocket or belt, or to an article of baggage such as a purse or backpack. The clip has an overall curved profile such that it is curved to meet a person's hip when clipped to a belt. One skilled in the art understands the various edges to which such a clip may be affixed.

The front section 112 of the truncated cylinder 111 is designed to accommodate a water bottle, which can be slid vertically into and out of the holder. The front section 112 is divided about a cut space 113 so that it expands to enlarge the diameter of the truncated-cylinder body 111, furthering its flexibility. One skilled in the art understands that a truncated cylinder such as front section 112 divided about a cut space 113 may be described as a wedge-shaped clip. Elongate vertical ridges 118 reduce the diameter of the cylindrical body to accommodate variously sized bottles and to reduce the friction during the sliding insertion of the bottle and accommodate out-of-round bottles. One skilled in the art understands that a larger container can fill the space between the ridges 118 while a relatively smaller container can be held by the ridges 118. A lip 117 extends along the top of the front section 112.

The clip 110 comprises a rear structure 114 and a front support member 115 which is integral to the truncated-cylinder body 111. A slot 124 is proportioned to slip onto a person's belt or waistband, and is curved to conform comfortably to a person's waist. The embodiment is made of a semi-rigid material or plastic which allows the clip 110 to flex.

Figure 2:
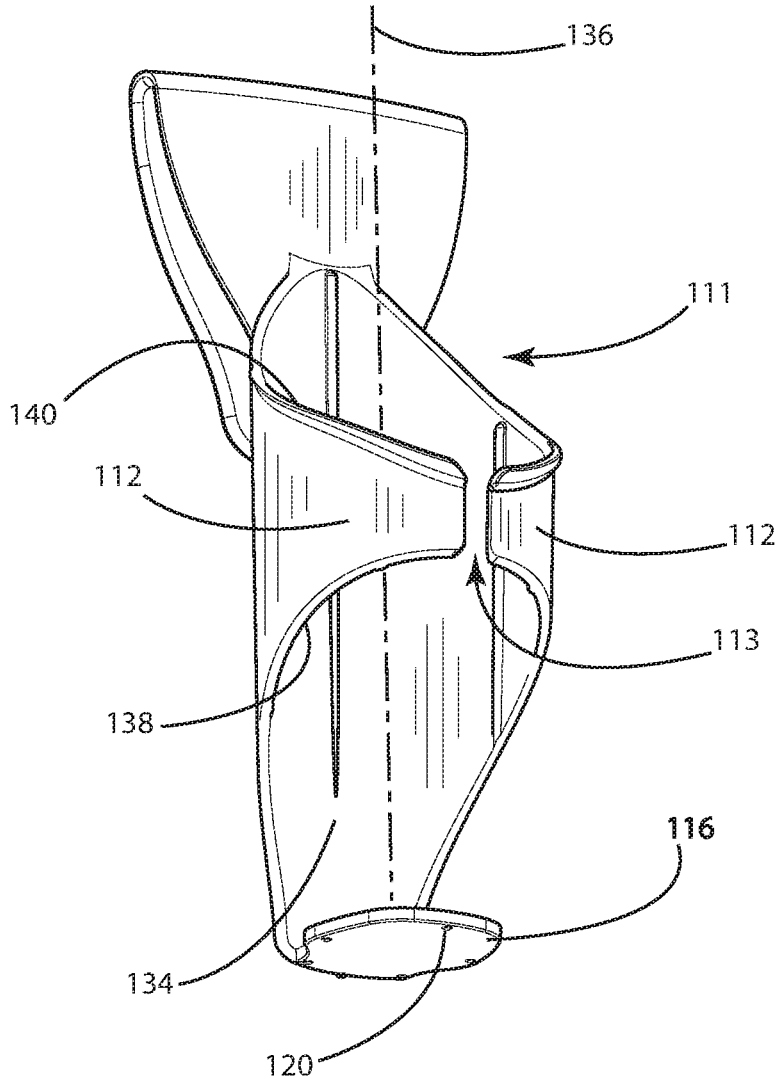
FIG. 2 is a front, bottom perspective view of the present embodiment.

FIG. 2 shows some details of the embodiment. Semi-spherical protrusions 120 on the exterior of the base portion 116 lend friction and provide balance when the embodiment is set on a flat, smooth surface such as a table. A centerline 136 resides about the center of a substantially cylindrical form that makes up the front section 112 of the truncated cylinder 111. The front section 112 may be seen as a pair of arms formed by a truncated cylindrical form 111 cut along top front 140 and bottom front 138 to form grasping arms. Arm shapes taper from rear vertical structure 134 toward a front cut space 113. Arms are tapered to grasp a beverage container, and constructed of a material that flexes for removal and replacement of a beverage container.

Figure 3:
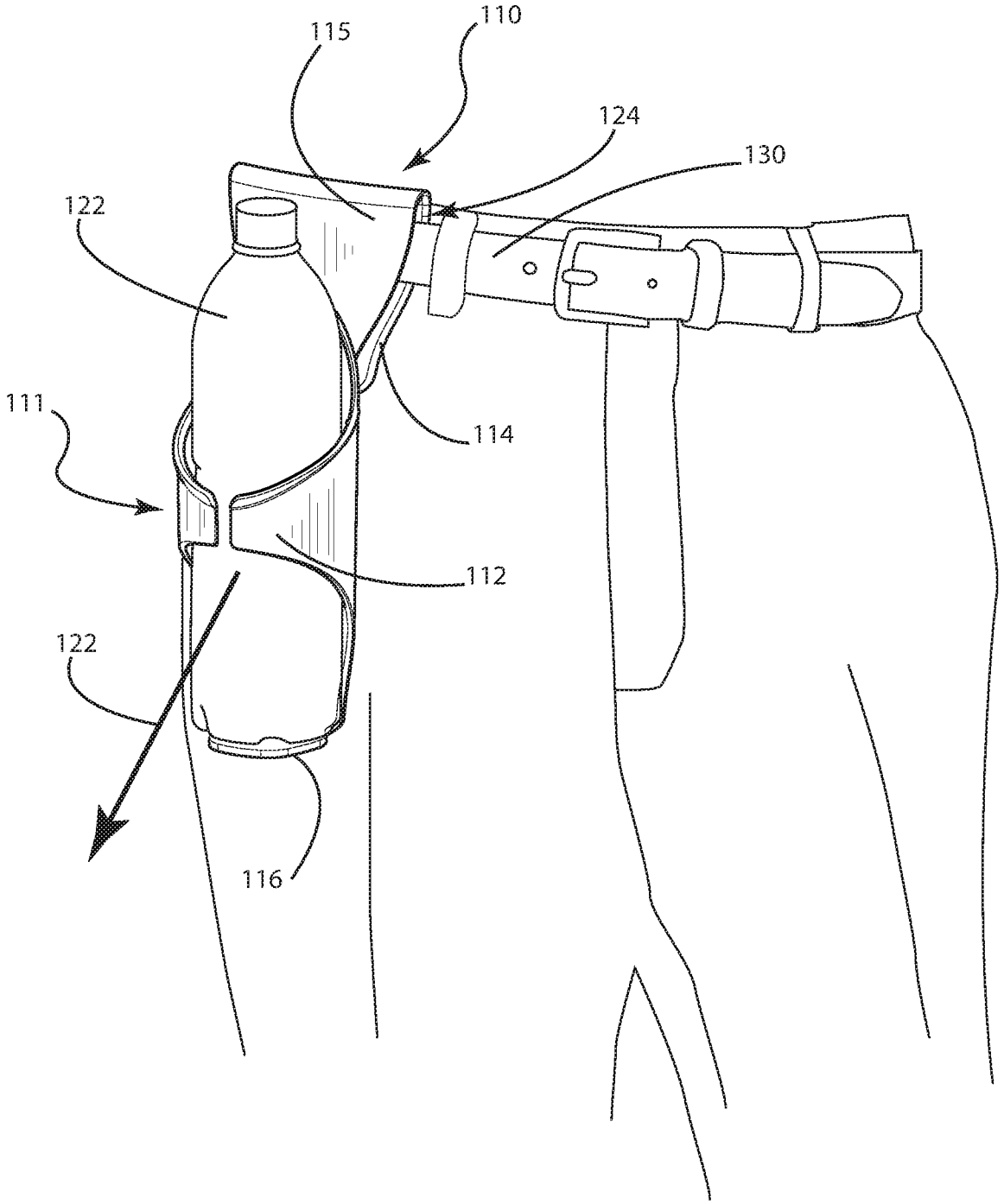
FIG. 3 is a perspective view of the present embodiment as worn on a belt.

FIG. 3 shows the embodiment as attached to a provided belt 130 and holding a provided water bottle 122. The embodiment attaches to a provided belt 130 via a curving clip 110 which is proportioned to slot 124 at a measure to accommodate common thicknesses of clothing, belts and luggage. The rear member 114 is designed to slide behind a belt, waistband, pocket, or other portion of clothing or baggage. In one example, the front section 112 of the truncated cylindrical form 111 and base 116 are sufficiently flexible so as to allow a user to remove the container by moving the container in a direction illustrated by arrow 123. This allows the container to be removed while keeping the clip 110 attached to the item which it is clipped on to, in this example, a belt.

Figure 4:
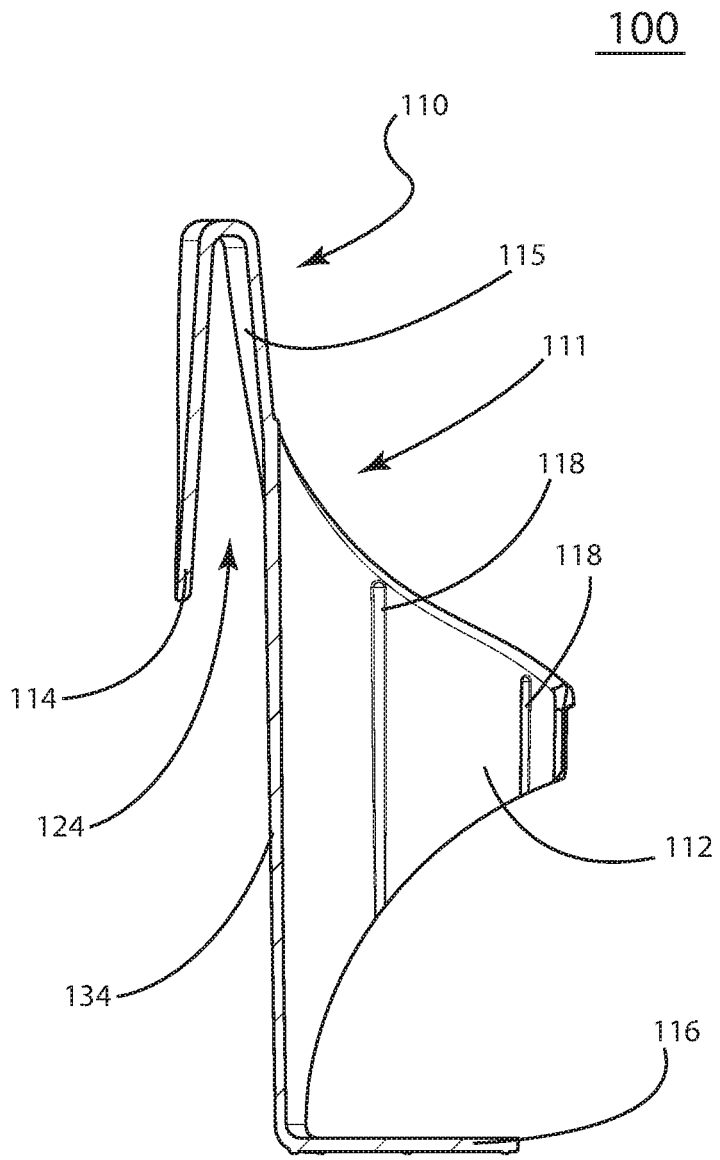
FIG. 4 is a side, cross-section view of the present embodiment; the other side is a mirror image.

FIG. 4 is a left side, cross-section view of the embodiment. The right side is a mirror image thereof. The truncated cylinder body 111 tapers to the partially cut front area 112. A vertical structure 134 extends between the clip 110 and the base 116. The clip 110 is integrally formed into the rear of the truncated-cylinder body 111 so as to form a loop with a rear member 114 and a front support member 115, attaching to a vertical structure 134 that extends downward to meet a base 116. The base protrudes perpendicularly from the vertical structure 134 and the cylindrical body 111. A slot 124 is formed at a measure to accommodate common thicknesses of clothing, belts or luggage. The rear member 114 is designed to slide along and behind a belt, waistband, or other portion of clothing or baggage. Elongate vertical ridges 118 reduce the diameter of the cylindrical body to accommodate variously sized bottles.

Figure 5:
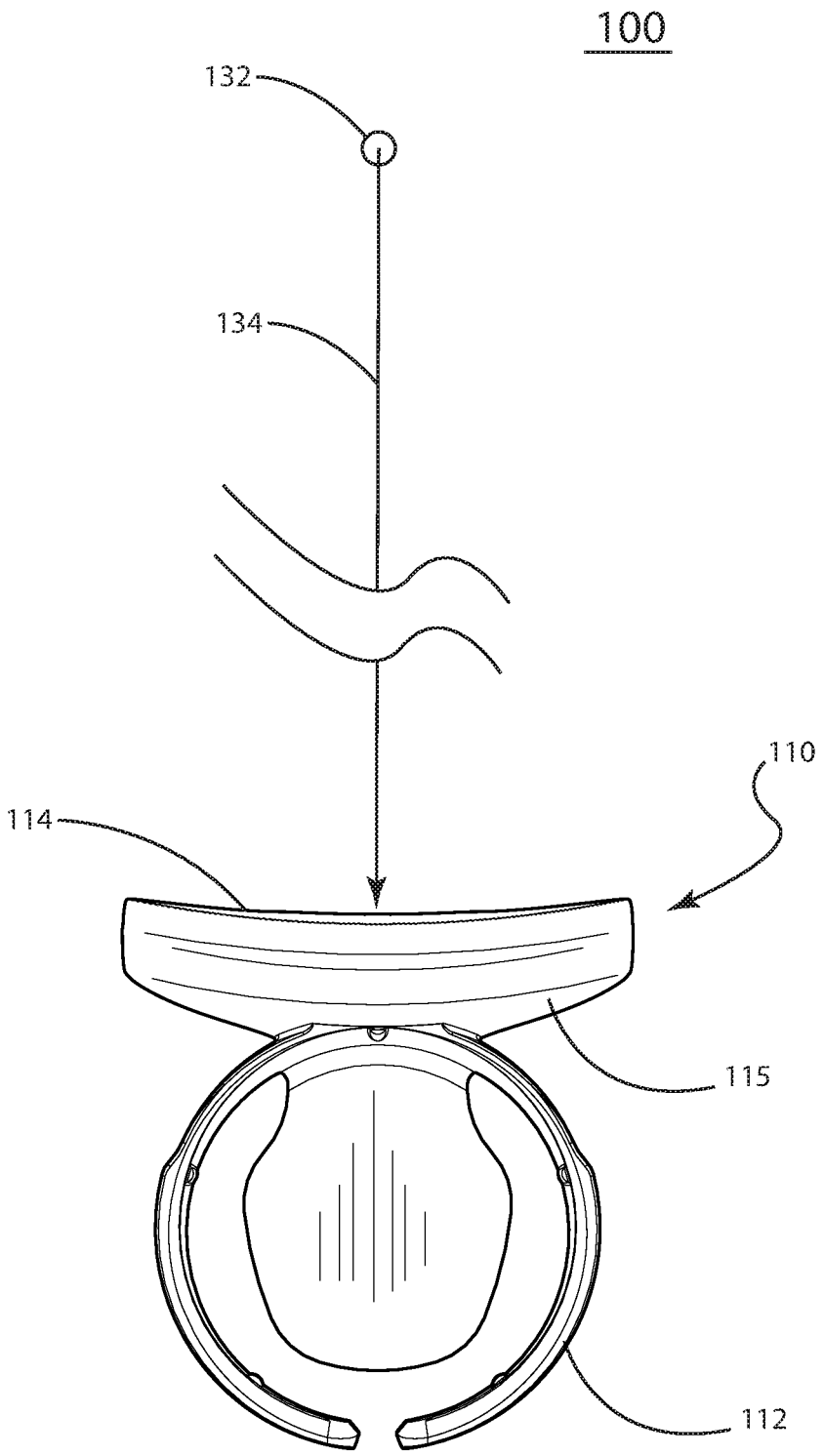
FIG. 5 is a top view depicting a radius in the form of the clip.

FIG. 5 is a top view of the embodiment illustrating a bend in the clip. The clip 110 is made up of the rear member 114 and front support member 115 that transition accurately at the top. The clip 110 is formed about a vertical structure 134 that is revolved about an axis located at point 132.

This example embodiment should not be construed as limiting.

The invention claimed is:

1. An apparatus for carrying a container comprising:

a wedge-shaped clip formed about two opposing arcuate planes; and said arcuate planes disposed about a first vertical axis; and said clip fixedly engaged and tangent to a vertical cylindrical form; and said vertical cylindrical form revolved about a second vertical axis that is parallel to said first vertical axis; and said vertical cylindrical form having a top end and a bottom end, and a right side and a left side; and said vertical cylindrical form truncated about the top end and bottom ends and split between said right side and said left side; and said vertical cylindrical form having an inside and an outside; and vertical ridges formed about the inside of the vertical cylindrical form;

a base extending from and perpendicular to said vertical cylindrical form bottom end; and protrusions on said base provide grip and balance when the apparatus is placed on a horizontal flat surface; wherein the apparatus is a single contiguous form having arms being sufficiently flexible and structural so as to hold a beverage container while allowing insertion and removal of the beverage container and wherein said protrusions on said base provide grip and balance when the apparatus is placed on a horizontal flat surface.

2. The apparatus for carrying a container of claim 1 further comprising:

a lip formed about the top of said vertical cylindrical form; wherein said lip provides structure to arms formed by said truncated vertical cylinder and aids in the centering and insertion of a container.

3. An apparatus for holding a container comprising:

a vertically oriented, substantially cylindrical body having an interior, an exterior, a front, a rear, a top and a bottom; and said substantially cylindrical body truncated about the top and bottom and separated at the front forming two arms wide at the back and narrow at the front; and a lip formed along the edge of the truncated top of said substantially cylindrical body;

vertical ridges disposed about the interior of the substantially cylindrical body; and a clip disposed about the top of the substantially cylindrical body; and a horizontal base structure disposed about the bottom of the substantially cylindrical body; and a portion of the exterior, proximal to the clip, curved to conform to a person's hip; wherein a beverage container placed within the substantially cylindrical body is held fast by the vertical ridges, the lip provides structure to said substantially cylindrical body, and the clip fits over an article of clothing, allowing a user to carry the beverage container attached to their clothing.

* * * * *